US007081620B2

(12) United States Patent
Kato

(10) Patent No.: US 7,081,620 B2
(45) Date of Patent: Jul. 25, 2006

(54) ATMOSPHERIC PRESSURE IONIZATION MASS SPECTROMETER SYSTEM

(75) Inventor: Yoshiaki Kato, Mito (JP)

(73) Assignee: Hitachi High -Technologies Corporation, Tokyo (JP)

( * ) Notice: Subject to any disclaimer, the term of this patent is extended or adjusted under 35 U.S.C. 154(b) by 0 days.

(21) Appl. No.: 10/239,063

(22) PCT Filed: Nov. 26, 2001

(86) PCT No.: PCT/JP01/10266

§ 371 (c)(1),
(2), (4) Date: Oct. 4, 2002

(87) PCT Pub. No.: WO03/046543

PCT Pub. Date: Jun. 5, 2003

(65) Prior Publication Data

US 2003/0122069 A1 Jul. 3, 2003

(51) Int. Cl.
*H01J 49/04* (2006.01)

(52) U.S. Cl. ..... 250/288

(58) Field of Classification Search ..... 250/288, 250/281, 283, 282

See application file for complete search history.

(56) References Cited

U.S. PATENT DOCUMENTS

| | | | | |
|---|---|---|---|---|
| 4,121,099 | A | 10/1978 | French et al. | |
| 4,137,750 | A | 2/1979 | French et al. | |
| 4,144,451 | A | 3/1979 | Kambara | |
| 4,542,293 | A | 9/1985 | Fenn et al. | |
| 4,935,624 | A | 6/1990 | Henion et al. | |
| 5,245,186 | A | 9/1993 | Chait et al. | |
| 5,306,412 | A | 4/1994 | Whitehouse et al. | |
| 5,345,079 | A * | 9/1994 | French et al. | 250/288 |
| 5,349,186 | A * | 9/1994 | Ikonomou et al. | 250/288 |
| 5,423,964 | A * | 6/1995 | Smith et al. | 204/452 |
| 5,485,016 | A * | 1/1996 | Irie et al. | 250/288 |
| 5,868,322 | A * | 2/1999 | Loucks et al. | 239/418 |
| 5,873,523 | A * | 2/1999 | Gomez et al. | 239/3 |
| 6,127,680 | A * | 10/2000 | Andrien et al. | 250/288 |

FOREIGN PATENT DOCUMENTS

| | | |
|---|---|---|
| JP | 6-215726 | 8/1994 |
| JP | 10-185876 | 7/1998 |
| JP | 2001-183344 | 7/2001 |

* cited by examiner

*Primary Examiner*—Jack I. Berman
(74) *Attorney, Agent, or Firm*—Dickstein Shapiro Morin & Oshinsky LLP

(57) ABSTRACT

In order to provide an atmospheric pressure ionization mass spectrometer system which allows for equal high sensitivity analysis for LCs with different flow rates, there is provided an atmospheric pressure ionization mass spectrometer system comprising: an atmospheric pressure ion source for ionizing a sample solution under atmospheric pressure, a mass spectrometer for mass analyzing the ions in an evacuated space, a fine hollow tube on a partition wall between the atmospheric pressure ion source and the mass spectrometer, the ions generated in the atmospheric pressure ion source being introduced through the fine tube into the mass spectrometer to be mass analyzed, wherein the fine tube consists of a first fine tube and a second fine tube which are different in diameter, the second fine tube being inserted in the first fine tube, the ions and gas generated in the atmospheric pressure ion source are introduced into the mass spectrometer through the second fine tube, and a gas is fed into a space between the first fine tube and the second fine tube. The present invention allows for high sensitivity measurements of mass spectrometer systems including the micro LC, CE, and nanospray with very low flow rate and the conventional LC with much higher flow rate. In addition, the clogged fine tube can be exchanged without stopping the vacuum pumping, providing the simplified maintenance.

15 Claims, 5 Drawing Sheets

ATMOSPHERIC PRESSURE IONIZATION MASS SPECTROMETER SYSTEM

BACKGROUND OF THE INVENTION

The present invention relates to an atmospheric pressure ionization mass spectrometer system, in which the sample solution is introduced and ionized under atmospheric pressure and the resultant ions are introduced into the high-vacuum mass spectrometer for mass analysis.

Recently, a liquid chromatograph directly coupled to an atmospheric pressure ionization mass spectrometer system (LC/MS) has been widely used for high sensitivity analysis of trace amounts of valuable or harmful materials in many organic compounds which exist in environments, food or organisms. This apparatus couples a liquid chromatograph (LC) of separating means and an atmospheric pressure ionization mass spectrometer system (API-MS) of high sensitive qualitative quantification means. LC/MS has been widely used in areas such as pharmacy, medicine, chemistry, and environmental science.

FIG. 7 schematically shows a general LC/MS. LC1 separates the sample solution into constituents. Separated constituents and mobile phase solvent pass through together a capillary tube 2 into an atmospheric pressure ion source 4. After arriving at a spray probe 3 of the atmospheric pressure ion source 4, the sample solution is sprayed into the atmosphere as charged fine droplets. The spraying is caused by high voltage applied to the probe 3 from a high voltage supply 5. The fine droplets travel in the atmospheric pressure ion source 4 to collide with the atmospheric molecules and become finer. Finally, the ions are emitted into the atmosphere. This is how the Electro-spray ionization (ESI) operates. The generated ions 6 move into the vacuum chamber 12 through the fine aperture or fine tube 8 on the vacuum wall of the mass spectrometer. The ions 6 then move to the vacuum chambers 15, 19 and into the mass spectrometer 17, which can mass analyze the ions 6 to provide mass spectrum.

In the atmospheric pressure ionization mass spectrometer system, are very important the fine aperture or fine tube between the atmospheric pressure ion source and the mass spectrometer of vacuum system. The atmospheric pressure ionization mass spectrometer system carries out the ionization under atmospheric pressure ($10^5$ Pa). The mass spectrometer needs, however, to work in a much lower pressure ($10^{-3}$ Pa or less). Thus, the ions must move into the mass spectrometer against a pressure difference of eight orders of magnitude. Usually, large vacuum pumps 20, 21, 22 are used to much of the gas introduced with the ions. However, there is generally a limit to the size and number of vacuum chambers in terms of economy and structure. Thus, throttle has been used to control the gas flow from the atmospheric pressure ion source to the mass spectrometer. The throttles is the fine aperture or fine tube on the partition wall between the atmospheric pressure ion source and the mass spectrometer. U.S. Pat. Nos. 4,121,099, 4,137,750, 4,144,451, and 4,935,624 disclose an atmospheric pressure ionization mass spectrometer system with a fine aperture. U.S. Pat. Nos. 4,542,293, 5,245,186 disclose an atmospheric pressure ionization mass spectrometer system with a fine tube.

SUMMARY OF THE INVENTION

The fine aperture and tube, and a differential pumping system having vacuum pumps for evacuating different vacuum chambers, coupled the atmospheric pressure ion source and the mass spectrometer. This coupling has caused many atmospheric pressure ionization mass spectrometer systems to be widely used. Various chromatographs for different application areas have also been coupled with the atmospheric pressure ionization mass spectrometer system. However, the coupling with various chromatographs has caused additional problems. That is to say, a different type of chromatograph has an extremely different optimum flow rate.

TABLE 1

| Chromatography type coupled with MS and its typical flow rate | | |
|---|---|---|
| Chromatography type | Flow rate range of mobile phase | Flow rate ratio |
| Conventional LC | 0.5 to 3 mL/min | 1 |
| Semi-micro LC | 0.3 to 0.1 mL/min | 1/10 |
| Micro Lc | 0.1 to 0.02 mL/min | 1/100 |
| CE, (Nano-spray) | to 10 mL/min | 1/100,000 |

Table 1 shows that the MS couples with chromatographs which have optimum flow rates differing by five orders of magnitude. Regardless of such a large difference in flow rate, commercially available LC/MSs have a constant pumping speed of the vacuum pumping system or a constant size of a fine aperture or fine tube, which cannot be changed for each type of chromatograph. Of course, the vacuum system of the mass spectrometer is designed for the conventional LC having the highest load. That is to say, the commercially available LC/MSs have used a fine aperture or fine tube which has high enough conductance to pass through much of gas, and a high capacity differential pumping system which can quickly evacuate the introduced gas.

The LC/MSs can provide the highest performance for the conventional LC or semi-micro LC, by using the above design. However they often cannot provide the expected performance for the micro LC or capillary electrophoresis (CE) having extremely low flow rate. It is because the micro LC or CE has extremely lower flow rate than the flow rate of the gas which can pass through the fine tube and be evacuated.

The micro LC or CE has difference of two to five orders of magnitude between the flow rate of the gas evaporated and generated in the ion source, and the pumping speed of the vacuum pumping system. In other words, the performance of the vacuum pump is two to five orders of magnitude higher. Thus, nitrogen gas introduced in the ion source may flow into the fine tube to compensate for the difference. The nitrogen gas will dilute the ions generated during spraying, up to 100 to 100,000 times within the fine tube. Many of the diluted ions may diffuse and be evacuated along with the neutral gas molecules during passing through the differential pumping system. This causes the fact that the LC/MS cannot provide the expected sensitivity in the range of extremely low flow rate.

U.S. Pat. No. 4,885,076 discloses coupled CE and MS which can supply a sheath flow of an additional solution around the CE eluate, and can spray and ionize the sheath flow along with the sample solution. This patent describes that the sheath flow can stabilize the spraying and ionization. However, this method also dilutes the sample solution so that it probably reduces the sensitivity.

The present invention provides an atmospheric pressure ionization mass spectrometer system which can prevent the sensitivity reduction in the range of low flow rate and allow for high sensitivity and stable measurements regardless of the large difference in flow rate.

To solve the above mentioned problems, the present invention provides an atmospheric pressure ionization mass spectrometer system comprising: an atmospheric pressure ion source for ionizing a sample solution under atmospheric pressure, a mass spectrometer for mass analyzing the ions in an evacuated space, a fine hollow tube on a partition wall between the atmospheric pressure ion source and the mass spectrometer, the ions generated in the atmospheric pressure ion source being introduced through the fine tube into the mass spectrometer to be mass analyzed, wherein the fine tube consists of a first fine tube and a second fine tube which are different in diameter, the second fine tube being inserted in the first fine tube, the ions and gas generated in the atmospheric pressure ion source are introduced into the mass spectrometer through the second fine tube, and a gas is fed into a space between the first fine tube and the second fine tube.

Preferably, an atmospheric pressure ionization mass spectrometer system according to the present invention further comprises a gas feeding tube for feeding a gas between the first fine tube and the second fine tube, a gas source connected to the gas feeding tube, and adjusting means on the gas feeding tube, for adjusting the gas flow rate.

DETAILED DESCRIPTION OF THE PREFERRED EMBODIMENTS

Figure 2:
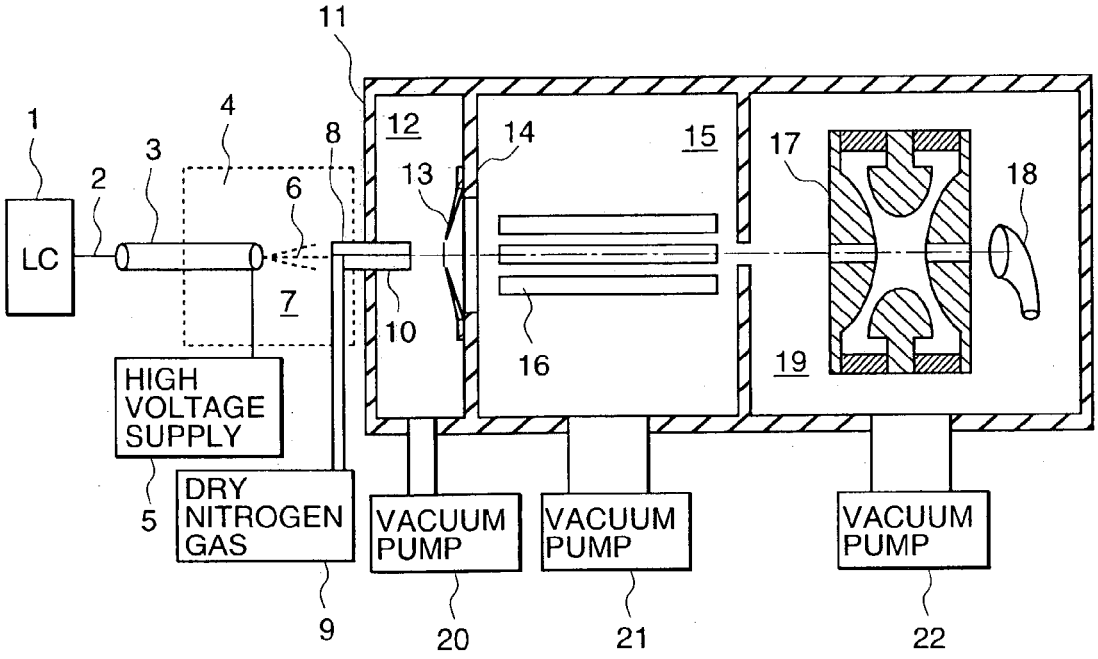
FIG. 2 shows an enlarged view of the atmospheric pressure ion source 4 and vacuum chamber 12 of the atmospheric pressure ionization mass spectrometer system of the present invention.

FIG. 2 shows a schematic diagram of the atmospheric pressure ionization mass spectrometer system of the present invention.

The sample solution is injected from a sample inlet of LC 1 and introduced into a separating column along with the mobile phase solution. The mobile phase solution is sent by pump. The separating column can separate the sample into constitutions. The mobile phase used includes water, organic solvents such as methanol and acetonitrile, and combinations thereof. Separated constituents and the mobile phase solution leave the separating column and enter an atmospheric pressure ion source 4 of the LC/MS through a capillary tube 2. A spray probe 3 has an end which is provided with high voltage of 3 to 5 kV from a high voltage supply 5. The sample solution is sprayed into the atmosphere 7 of the atmospheric pressure ion source 4 as charged fine droplets. The spraying is caused by high speed nitrogen gas jetted out in the direction of the spray probe 3 and the high voltage. The charged fine droplets collide with the atmospheric gas molecules and become finer. Finally, ions are emitted into the atmosphere 7. The ions move into a vacuum chamber 12 through the second fine tube 10 on a vacuum wall 11 of the mass spectrometer. The vacuum chamber 12 is generally evacuated by a vacuum pump 20 of a rotary pump (RP) to pressure of about 100 Pa. After being emitted into the vacuum chamber 12, the ions move straight and pass through a fine aperture on a skimmer 13. After passing through the fine aperture of the skimmer 13, the ions move into a vacuum chamber 15 which is evacuated by a vacuum pump 21 to a lower pressure than the vacuum chamber 12. The ions are converged by an ion guide 16 in the chamber 15. The converged ions reach a high vacuum chamber 19 which has a mass spectrometer 17. The high vacuum chamber 19 is generally evacuated by a vacuum pump 22 to pressure of $10^{-3}$ Pa or less. The ions are mass analyzed by the mass spectrometer 17 and detected by a detector 18 to provide mass spectrum.

In the atmospheric pressure ionization mass spectrometer system, it is most important to keep the mass spectrometer in low pressure ($10^{-3}$ Pa or less) necessary for its operation, while sending as many as possible of the ions generated under atmospheric pressure into the mass spectrometer. However it is impossible to send only ions into the mass spectrometer and much of gas is sent with the ions. Many of the atmospheric pressure ionization mass spectrometer systems use the differential pumping system in which plural vacuum pumps operate to maintain a pressure difference.

In the differential pumping system, is most important the structure of the first stage pumping system which evacuates from atmospheric pressure with the rotary pump (RP). The ion transfer efficiency will be 100% at this stage, if all of the gas containing the ions generated in the atmospheric pressure ion source can be sent into the mass spectrometer.

It is also important to prevent the loss of ions due to the ion dilution or diffusion during the ion transfer. In low pressure region ($10^{-3}$ Pa or less), the ions can easily be converged by the electrical field to prevent the diffusion. In the first stage pressure region (100 Pa) evacuated by the rotary pump, which is referred to as a viscous flow region, it is difficult to converge the ions by the electrical field. The ions and the neutral gas molecules may diffuse and be evacuated by the RP.

The LC/MS supplies the sample and mobile phase in a liquid state to the atmospheric pressure ion source 4. The sample solution is sprayed and evaporated to a gas. The water and methanol, when heated from a room temperature to 200° C., will expand to 2000 and 1000 times the initial volume, respectively. The conventional LC mostly uses the mobile phase at a flow rate of 1 (mL/min). Thus, the mobile phase of methanol can supply 1 (L/min) of gas into the atmospheric pressure ion source after spraying and evaporating. The gas then moves from the atmosphere to the mass spectrometer through the fine tube.

PR provides a pressure of about 100 Pa. This pressure region is referred to as a viscous flow region. The conductance C ($m^3/s$) of the fine tube in this pressure region is given by the following equation (1), $$C=1349*(d^4/L)*\{(P_1+P_2)/2\} \quad (1)$$

where d is the diameter of the fine tube (m), L is the length of the fine tube (m), $P_1$ and $P_2$ are the pressures at either end of the fine tube (Pa).

Figure 3:
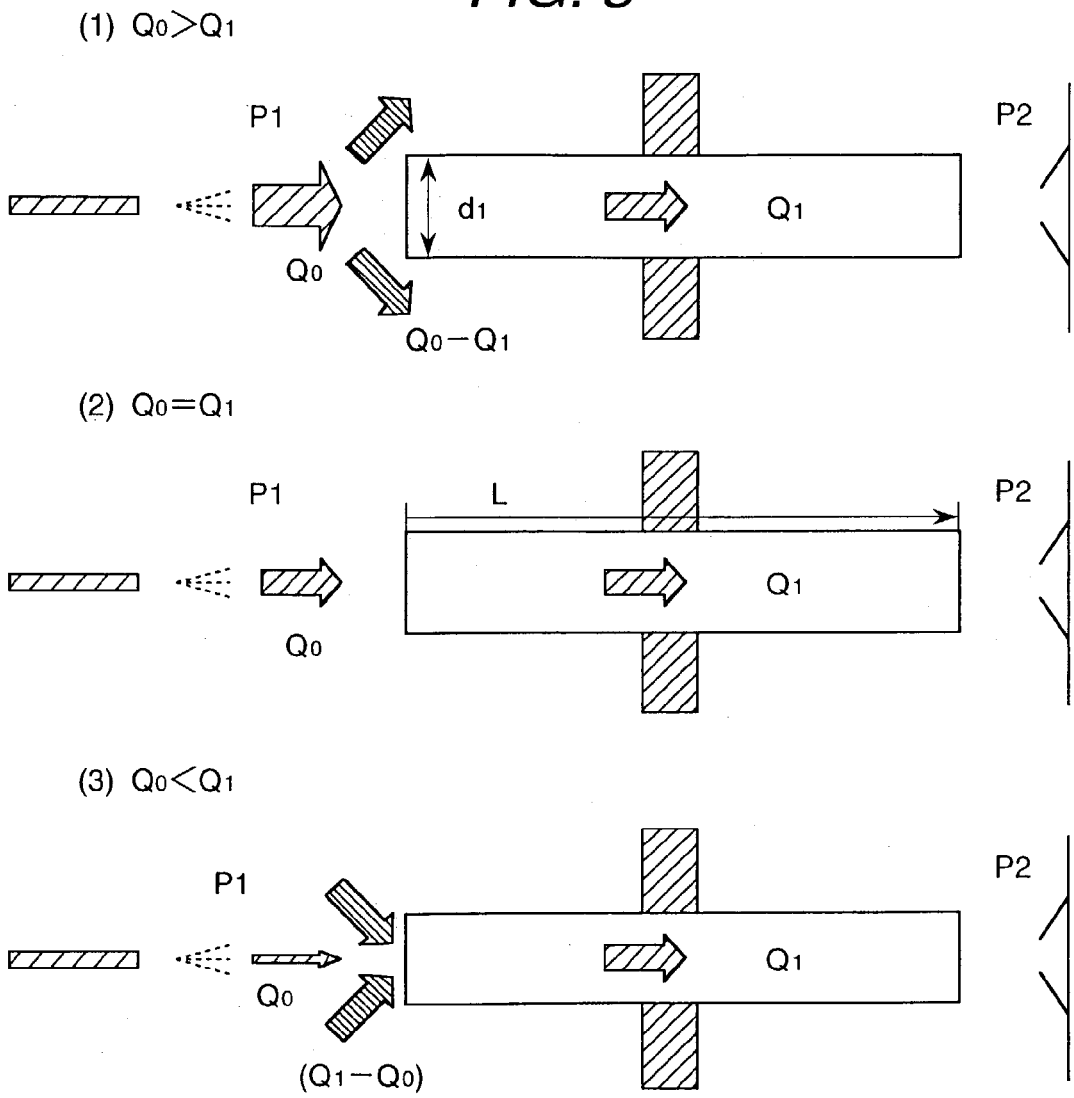
FIG. 3 shows different operations of the atmospheric pressure ionization mass spectrometer system for different flow rates of the sample.

As shown in FIG. 3, the sample gas containing the ions generated at pressure $P_1$ has a flow rate $Q_0$. A portion of the sample gas can pass through the fine tube at a flow rate $Q_1$ ($m^3$·Pa/s). The $Q_1$ is given in the following equation (2).

$$Q_1=C(P_1-P_2) \quad (2)$$

This equation can be approximated to the following equation (3) when $P_1>>P_2$.

$$Q_1=C*P_1 \quad (3)$$

There may be following three relations (A), (B), and (C) between the sample gas flow rate $Q_0$ generated in the atmospheric pressure ion source and the gas flow rate $Q_1$ passing through the fine tube.

(A) The sample gas flow rate $Q_0$ generated in the atmospheric pressure ion source is higher than the $Q_1$.

($Q_0>Q_1$) (FIG. 3(1))

Only a portion of the generated gas and ions can move to the mass spectrometer. The rest ($Q_0-Q_1$) will be discarded from the atmospheric pressure ion source into the atmosphere.

(B) The sample gas flow rate $Q_0$ generated in the atmospheric pressure ion source is equal to the $Q_1$.

($Q_0=Q_1$) (FIG. 3(2))

Most of the sample gas can pass through the fine tube. The ions dilution with the nitrogen gas in the atmospheric pressure ion source will be minimized.

(C) The sample gas flow rate $Q_0$ generated in the atmospheric pressure ion source is lower than the $Q_1$.

($Q_0<Q_1$) (FIG. 3(3))

All of the generated gas and ions can move through the fine tube into the mass spectrometer. An amount of gas corresponding to ($Q_0-Q_1$) will also move into the fine tube from the periphery of the tube inlet and dilute the sample gas within the tube.

If the diameter of the fine tube: d is 0.4 mm, the length of the tube: L is 0.12 m, the pressure of the atmospheric pressure ion source: $P_1$ is $10^5$ Pa, and the pressure of the vacuum chamber evacuated by the RP: $P_2$ is 100 Pa, the conductance of the fine tube: C is calculated as follows from the equation (1).

$$\begin{aligned} C &= 1349*\{(4*10^{-4})^4/(12*10^{-2})\}*\{(10^5+10^2)/2\} \quad (4) \\ &= 1.44*10^{-5}\ (m^3/s) \\ &= 0.864\ (L/min) \approx 1\ (L/min) \end{aligned}$$

The equations (2) and (4) show that the gas of a flow rate $Q_1$=about 1 (L·atm/min) can pass through the fine tube in the case of the diameter 0.4 mm, the length 12 cm, and the pressure difference across the fine tube 1 atm ($10^5$ Pa).

Table 2 shows examples of chromatography types used for LC/MS, their typical flow rates, and the fine tubes having corresponding conductance C (which gives $Q_0=Q_1$).

TABLE 2

Chromatography types used for LC/MS and their corresponding fine tubes

| Chromatography type | Flow rate | Converted gas flow rate | Flow rate ratio | Corresponding fine tube* (inside diameter) |
|---|---|---|---|---|
| Conventional LC | 1 mL/min | 1 L/min | 1 | 0.4 mm |
| Semi-micro LC | 100 μL/min | 100 mL/min | 1/10 | 0.2 mm |
| Micro LC | 10 μL/min | 10 mL/min | 1/100 | 0.1 mm |
| CE, (Nanospray) | 10 nL/min | 0.01 mL/min | 1/100,000 | 0.02 mm |

*All the fine tubes of 120 mm length.

The conventional LC introduces the solution into the ion source at a flow rate of 1 (mL/min), which can be converted to the gas flow rate: $Q_0$=about 1 (L/min). The fine tube having the inside diameter 0.4 mm*the length 120 mm can give $Q_0=Q_1$ and alomost 100% of the sample gas flow rate $Q_0$ can move through the fine tube into the mass spectrometer.

The micro LC introduces the solution into the ion source at a flow rate of 10 (μL/min), which can be converted to the gas flow rate: $Q_0$=about 10 (mL atom/min). Other gases are also introduced into the atmospheric pressure ion source, such as an auxiliary gas for spraying and a bus gas for making sprayed droplets finer, in addition to the sample solution. The auxiliary gas and the bus gas use a dry nitrogen gas. The micro LC introduces the gases at the flow rate of 10 (mL·atom/min). This flow rate is very lower than the conductance of about 1 (L/min) as given in the equation (4) for the fine tube with the inside diameter 0.4 mm*the length 120 mm. That is to say, $Q_0<Q_1$, so that, as shown in FIG. 3(3), the spraying gas or bus gas will flow into the fine tube to compensate for this difference ($Q_1-Q_0$). Those gases will dilute the sample gas within the fine tube up to about 100 times according to the relation of $Q_0/Q_1$=about 1/100.

The nanospray has more difference between the sample gas flow rate $Q_0$ and the fine tube flow rate $Q_1$:$Q_0<<Q_1$. The sample gas will be diluted up to 100,000 times according to the relation of $Q_0/Q_1$=1/100,000. The diluted sample gas will diffuse in the first stage chamber of the differential pumping system, and greatly reduced number of the ions can reach the mass spectrometer.

The dilution within the fine tube may be prevented by selecting and mounting a fine tube with an appropriate conductance C to the sample solution introduced into the atmospheric pressure ion source. That is to say, to realize $Q_1=Q_0$, the fine tubes corresponding to each chromatography type listed in Table 2 may be mounted.

This causes, however, an additional problem. The vacuum system is usually designed for the conventional LC having the highest load. The first stage RP of the differential pumping system can evacuate gas at a rate of about 1 (L atm/min) under a pressure of 100 Pa. FIG. 3 (2) shows a combination of the conventional LC and the fine tube (0.4 mm*120 mm) with an appropriate conductance. After passing through the fine tube, the gas enters the first stage chamber (the vacuum chamber 12) of the differential pumping system. The gas then rapidly diffuses due to the drastic pressure drop in the chamber. The straightforward fraction of the gas can only move through the fine aperture on the tip of the skimmer 13 into the vacuum chamber 15. The diffusing fraction of the gas will be evacuated by the RP.

Figure 4:
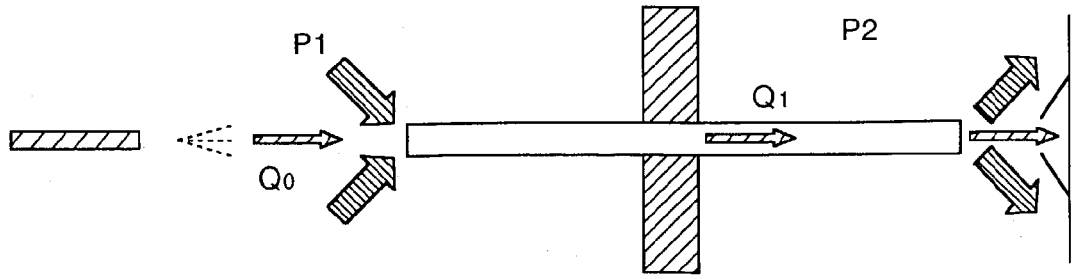
FIG. 4 shows an operation of the atmospheric pressure ionization mass spectrometer system using a finer tube.

FIG. 4 shows a fine tube with an inside diameter of 0.1 mm corresponding to the micro LC. This fine tube has a conductance C which is, with respect to the conductance of the 0.4 mm fine tube, $(0.1/0.4)^4$ times about 1 (L/min) or $1000*(1/4)^4=3.9$ (mL/min). Therefore, a limited gas flow rate of about 4 (mL/min) is introduced into the first stage chamber (the vacuum chamber 12) of the differential pumping system. This causes the sample gas flow rate $Q_0$ and the fine tube flow rate $Q_1$ ($Q_0=Q_1$) to be balanced. With one-hundredth of the gas flow being introduced into the vacuum chamber, the RP with a high pumping speed will reduce the pressure $P_2$ of the first stage chamber of the differential pumping system from 100 Pa to a low pressure of few Pascals. After passing through the fine tube, the gas $Q_1$ enters the first stage chamber of the differential pumping system and rapidly diffuses due to the drastic pressure drop in the chamber, as described above. The gas may further diffuse than in the conventional LC, because the vacuum chamber 12 has a pressure $P_2$ which is two orders of magnitude lower than that in the conventional LC. Thus, the micro LC can send much smaller fraction of the ions through the fine aperture on the tip of the skimmer 13 into the vacuum chamber 15 than the conventional LC. Therefore, the micro LC may lose more ions due to the ion diffusion than the conventional LC. The CE or nanospray may lose much more ions due to the ion diffusion in the vacuum chamber.

As described above, only changing the fine tube size to optimize the conductance C is insufficient and the micro LC, CE, or nanospray will lose many ions due to the gas dilution in the fine tube or the diffusion in the vacuum chamber. The loss of ions mainly causes the sensitivity reduction. In addition, the fine tube change is extremely inefficient, because it needs stopping the apparatus, changing the tube, and restarting the apparatus.

The above mentioned problem can be solved by keeping the constant pressure in the first stage chamber (the vacuum chamber 12) of the differential pumping system regardless of the different gas flows introduced into the vacuum chamber 12. The constant pressure in the vacuum chamber 12 can make the losses of ions in the chamber 12 almost the same. To keep the constant pressure, the pumping speed of the vacuum pump 20 can be controlled according to the gas flow introduced. The vacuum pump for pumping to a pressure of about 100 Pa includes a rotary pump (RP). It is difficult to externally control the pumping speed of the RP. Instead, a gate valve between the RP and the vacuum chamber can change the conductance. However, this technique cannot easily provide the optimum pressure condition. In addition, it is not economically advantageous because it needs an expensive gate valve.

The present invention provides a technique which can keep the almost constant gas flow rate through the fine tube regardless of the gas flow rate generated in the atmospheric pressure ion source, without changing the RP pumping speed at the first stage chamber (the vacuum chamber 12) of the differential pumping system.

Figure 1:
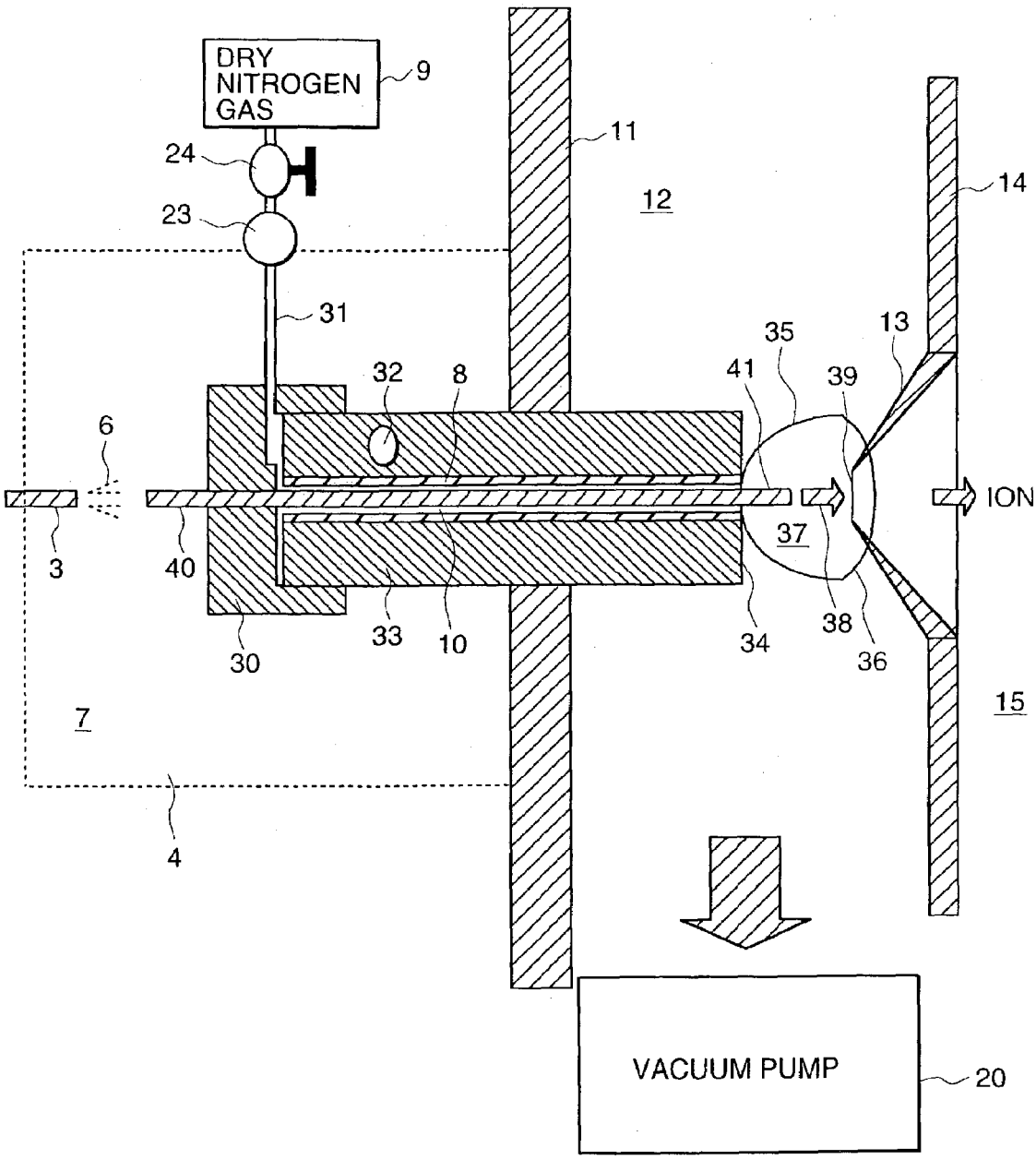
FIG. 1 shows a schematic diagram of the atmospheric pressure ionization mass spectrometer system of the present invention.

FIG. 1 shows an enlarged view of the atmospheric pressure ion source 4 and vacuum chamber 12 which configure the main part of the present invention.

In the present invention, the fine tube between the atmospheric pressure ion source 4 and the vacuum chamber 12 consists of a first fine tube 8 of a given inside diameter (0.4 mm) and a second fine tube 10 of an given outside diameter (0.3 mm) which is smaller than the inside diameter of the first fine tube 8. The second fine tube 10 is inserted in the first fine tube 8 to provide a double-tube structure. The second fine tube 10 may be made of metal or may be a fused silica capillary. The fused silica capillary is preferable because it is easily available, inexpensive, and convenient.

The atmospheric pressure side of the fine tube has a seal nut for fixing the first fine tube 8 and the second fine tube 10, and a gas feeding tube 31 for feeding the dry nitrogen gas 9 into the space between the first fine tube 8 and the second fine tube 10. The flow rate of the nitrogen gas can be externally controlled by the needle valve 24 to keep the optimum pressure in the vacuum chamber 12. The gas feeding tube 31 can have a heater 23 to efficiently heat the second fine tube 10.

A metal block 33 surrounds the first fine tube 8. The metal block 33 contains a heater 32 for heating the first and second fine tubes 8, 10.

The second fine tube 10 is longer than the first tube 8 and is fixed to the metal block 33 by the seal nut 30. The second fine tube 10 has one end 40 on the atmospheric pressure side, which projects into the atmosphere 7 in the atmospheric pressure ion source 4. Thus, the second fine tube 10 can suck the gas and ions 6 sprayed from the spray probe 3. The seal nut 30 makes the first fine tube 8 to be in communication only with the gas feeding tube 31, not with the atmosphere 7.

The first and second tubes 8, 10 penetrate the partition wall 11 between the atmospheric pressure ion source 4 and the vacuum chamber 12. The chamber 12 is the first stage chamber of the differential pumping system. The sprayed gas and ions pass through the second fine tube 10 and are least diluted by the nitrogen gas or other gases. The nitrogen gas 9 passes through the space between the first fine tube 8 and the second fine tube 10 and is emitted into the vacuum chamber 12 evacuated by the vacuum pump 20. The nitrogen gas then rapidly diffuses due to the drastic pressure drop in the chamber 12. Generally, when the diffusion velocity of the gas molecules reaches the sound velocity, a shockwave is formed. Therefore, the end 34 of the first fine tube 8 forms a barrel shockwave 35 and a mach desk 36 ahead of the shockwave 36. The skimmer 13 is located on the partition wall 14 between the vacuum 12 and the adjacent vacuum chamber 15. The tip of the skimmer 13 is located in the mach desk 36. The tip of the skimmer 13 has a fine aperture 39 through which the ions are sampled.

Figure 6:
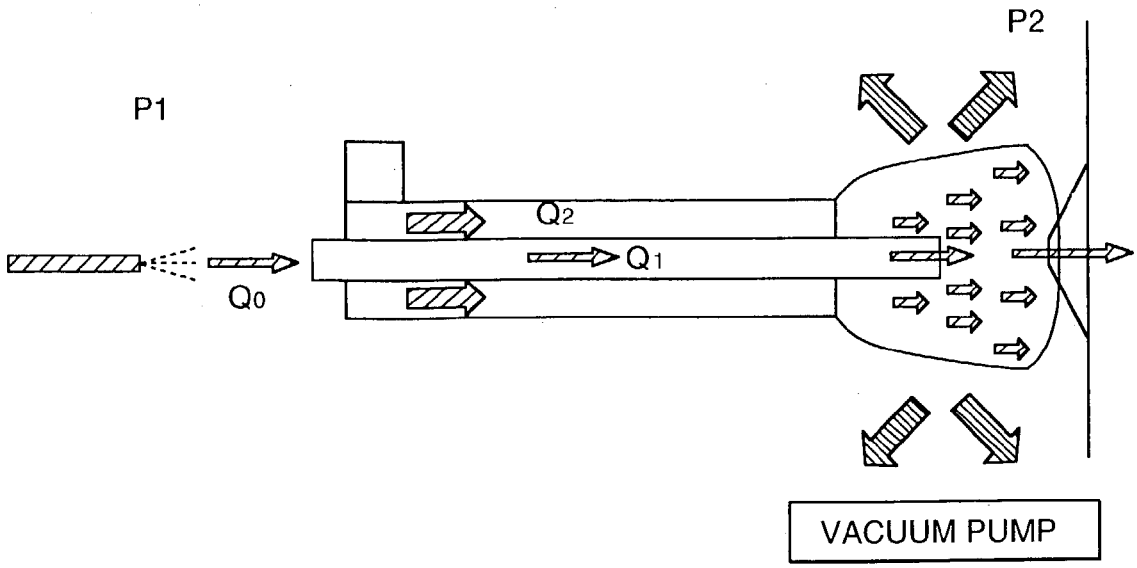
FIG. 6 shows an operation of the atmospheric pressure ionization mass spectrometer system of the present invention.
Figure 7:
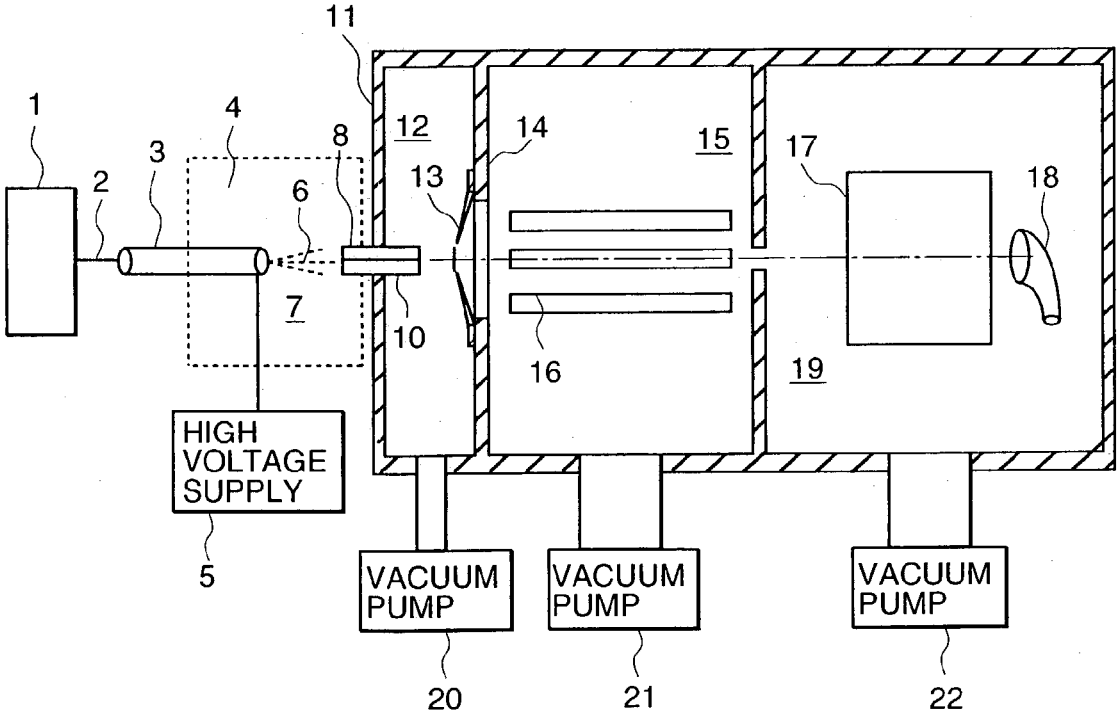
FIG. 7 shows a schematic diagram of the conventional LC/MS.

The second fine tube 10 has the other end 41 which projects past the end 34 of the first fine tube 8 toward the skimmer 13. Thus, the other end 41 of the second fine tube 10 is located in the barrel shockwave 37 formed. The gas molecules in the barrel shockwave 37 adiabatically expand and diffuse to systematically have translational motion toward downstream. This zone (in the barrel shockwave 37) is particularly referred to as "Silence Zone." In the shockwave 35 and mach desk 36, the gas molecules are adiabatically compressed and the zone past the shockwave 35 will be a zone of random thermal motion. As shown in FIG. 6, the second fine tube 10 has the outlet in the barrel shockwave 37, so that the ions flow can have the least diffusion after passing through the second fine tube 10 and being emitted into the barrel shockwave 37. The nitrogen gas around the ions flow has translational motion and can serve as a sheath gas for the ions flow to minimize the diffusion and dilution of the ions. The ions flow can move linearly toward downstream in the barrel shockwave 37 and pass through the fine aperture 39 on the tip of the skimmer 13. The ions then move to the adjacent vacuum chamber 15 and into the high vacuum chamber 19 which has the mass spectrometer 17 to mass analyze the ions. Most of the nitrogen gas emitted from the first fine tube 8 is excluded by the skimmer 13 and evacuated by the vacuum pump 20.

Figure 5:
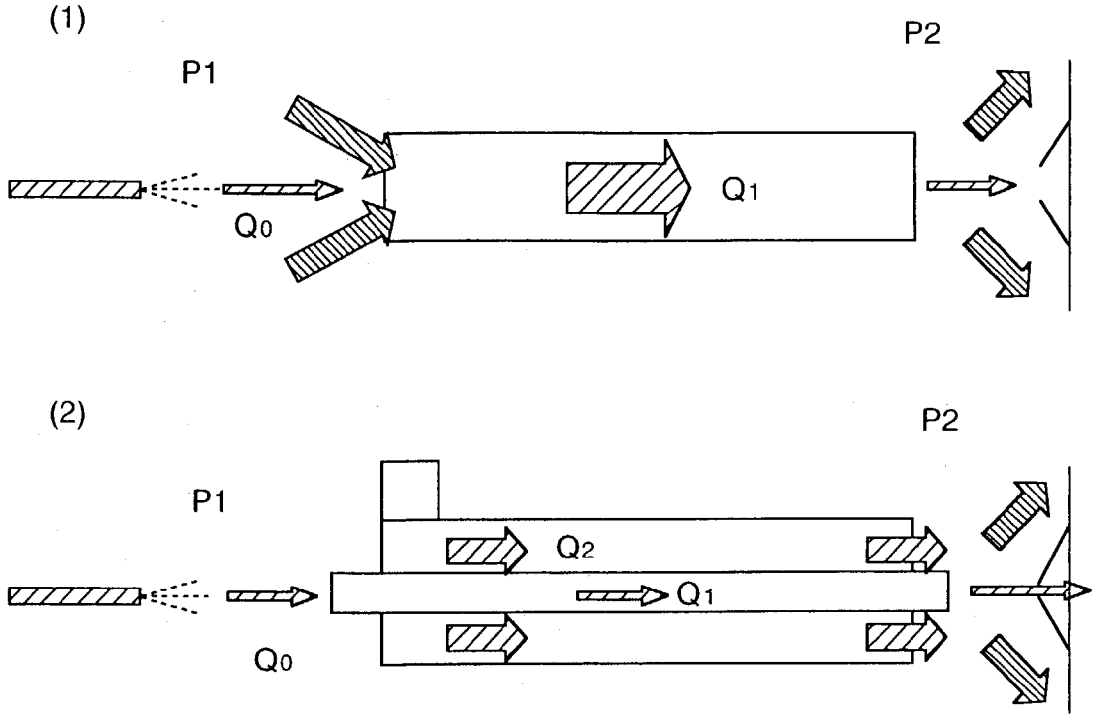
FIG. 5 shows different operations of the atmospheric pressure ionization mass spectrometer system for a single fine tube and plural fine tubes.

According to the present invention, the apparatus has separate two fine tubes: a fine tube for the sample gas including ions and another fine tube for the nitrogen gas. Thus, unlike the conventional case with a single fine tube, a very low flow of the sample gas can move to the vacuum chamber 12 without being diluted with the nitrogen gas in the fine tube. FIG. 5 shows gas flows for a single fine tube in the conventional configuration (FIG. 5(1)), and gas flows for two separate fine tubes in the configuration according to the present invention (FIG. 5(2)). In the case of FIG. 5(1), the sample-gas flow and the fine tube flow have a relationship of $Q_0' << Q_1$. In the case of FIG. 5(2), the sample gas flow and the fine tube flow have a relationship of $Q_0' = Q_1' << Q_2$. Thus, for the configuration according to the present invention in FIG. 5(2), most of the gas introduced into the vacuum chamber 12 is the nitrogen gas which flows through the space between the first fine tube 8 and the second fine tube 10. The flow of the nitrogen gas can be controlled to keep the optimum pressure in the vacuum chamber 12. The flow rate of the nitrogen gas can easily be controlled by adjusting the needle valve 24. Consequently, it is possible to prevent the loss of ions due to the dilution in the fine tube or the diffusion and evacuate in the vacuum chamber 12.

According to the configuration of the present invention, the second fine tube 10 can easily be exchanged without stopping the operation of the vacuum pump in the MS. The second fine tube 10 may be exchanged by loosening the seal nut 30 and pulling out the second fine tube 10 with keeping the pumping of the apparatus. The air sucked through the first fine tube 8 will not affect the vacuum in the mass spectrometer. The exchange of the second fine tube 10 will be completed by attaching a new second fine tube 10 on the seal nut 30, reinserting the tube 10 into the first fine tube 8, and feeding the nitrogen gas between the two tubes. After about 30 minutes for stabilizing the vacuum and the temperature of the fine tube, the LC/MS measurements can be restarted.

In fact, such a trouble is often had that the second fine tube 10 is clogged by the precipitation of the sample or the dust. In this case, according to the present invention, the fine tube 10 can easily be exchanged without stopping the whole apparatus or the vacuum pump.

Because the second fine tube 10 can easily be exchanged, the optimum second fine tube 10 can be selected according to the flow rate of the connected LC to increase the ion permeability.

For example, as shown in Table 2, the second fine tube 10 with an inside diameter of 0.2 mm or less can be selected and attached for the semi micro LC. The second fine tube 10 with an inside diameter of 0.1 mm or less can be selected and attached for the micro LC. The second fine tube 10 with an inside diameter of 0.02 mm or less can be selected and attached for the CE (nanospray). With the fine adjustment of the nitrogen gas flow rate with the needle valve, the optimum condition can constantly be kept. The second fine tube 10 may be removed to leave the first fine tube 8 for connecting the conventional LC for analysis.

Although the present invention has been described in relation to the ESI ion source of the atmospheric pressure ion source, the present invention is also applicable to other atmospheric pressure ion sources such as an atmospheric-pressure chemical ionization ion source (APCI ion source). This case provides a combination of the chromatographs with very different flow rates and the APCI. The APCI operates the same as the ESI after evaporation and ionization, so that the present invention is applicable to the APCI.

In the present invention, there is no limit to the mass spectrometer. Any mass spectrometer widely used at present can be used, such as a quadruple MS (QMS), ion trap, magnetic field MS, and TOFMS.

The present invention can provide an atmospheric pressure ionization mass spectrometer system which can adapt to the chromatographs with very different flow rates and can achieve constantly the high sensitivity analysis. A very simplified maintenance is also achieved.

What is claimed is:

1. An atmospheric pressure ionization mass spectrometer system comprising:

an atmospheric pressure ion source having a spray probe for generating ions of a sample solution by spraying said sample solution from said spray probe into a space under the atmospheric pressure so as to ionize said sample solution sprayed in said space under said atmospheric pressure;

a mass spectrometer for mass analyzing the ions in an evacuated space;

a fine hollow tube provided through a partition wall between said atmospheric pressure ion source and said mass spectrometer and gaseous ions generated in said atmospheric pressure ion source being introduced through said fine tube into said mass spectrometer to be mass analyzed, wherein said fine tube comprises a first fine tube and a second fine tube which are different in diameter, said second fine tube being inserted in said first fine tube, a first space formed between said first fine tube and said second fine tube and a second space formed in said second fine tube respectively have respective inlet ends and respective outlet ends, and said respective inlet ends are arranged in said space under the atmospheric pressure of said atmospheric pressure ion source and said respective outlet ends are arranged in evacuated space of said mass spectrometer, said gaseous ions generated in said atmospheric pressure ion source and gas are fed into said inlet end of said second space, and sheath gas is fed into said inlet end of said first space, and said gaseous ions and said gas guided into said second space are coaxially emitted from said outlet end of said first space into a flow of said sheath gas flown with a sound velocity formed in a vacuum chamber evacuated.

2. An atmospheric pressure ionization mass spectrometer system according to claim 1, further comprising:

a gas feeding tube for feeding said sheath gas between said first fine tube and second fine tube, a gas source connected to said gas feeding tube, and adjusting means on said gas feeding tube, for adjusting said sheath gas flow rate.

3. An atmospheric pressure ionization mass spectrometer system according to claim 2, further comprising heating means on said gas feeding tube, for heating the gas.

4. An atmospheric pressure ionization mass spectrometer system according to claim 1, wherein said first fine tube has an end on the mass spectrometer side, said second fine tube has an end on the mass spectrometer side, and said second fine tube end projects past said first fine tube end toward the mass spectrometer.

5. An atmospheric pressure ionization mass spectrometer system according to claim 1, wherein said first fine tube has an end on the atmospheric pressure ion source side, said second fine tube has an end on the atmospheric pressure ion source side, and said second fine tube end projects past said first fine tube end toward the atmospheric pressure ion source.

6. An atmospheric pressure ionization mass spectrometer system according to claim 5, wherein said first fine tube is not in communication with the atmospheric pressure ion source side.

7. An atmospheric pressure ionization mass spectrometer system according to claim 1, wherein said second fine tube is a fused silica capillary.

8. An atmospheric pressure ionization mass spectrometer system according to claim 1, wherein said second fine tube can be removed and exchanged, with holding said first fine tube on said partition wall.

9. An atmospheric pressure ionization mass spectrometer system according to claim 1, further comprising heating means, which surround said first fine tube and second fine tube, for heating them.

10. An atmospheric pressure ionization mass spectrometer system according to claim 2, wherein the mass analysis is carried out with said second fine tube removed, for a sample solution flow rate of 0.3 mL/min or more.

11. An atmospheric pressure ionization mass spectrometer system according to claim 2, wherein the mass analysis is carried out with said second fine tube having an inside diameter of 0.2 mm or less, for a sample solution flow rate of 0.3 mL/min or less.

12. An atmospheric pressure ionization mass spectrometer system according to claim 2, wherein the mass analysis is carried out with said second fine tube having an inside diameter of 0.1 mm or less, for a sample solution flow rate of 0.01 mL/min or less.

13. An atmospheric pressure ionization mass spectrometer system according to claim 2, wherein the mass analysis is carried out with said second fine tube having an inside diameter of 0.02 mm or less, for a sample solution flow rate of 0.001 mL/min or less.

14. An atmospheric pressure ionization mass spectrometer system according to claim 1, wherein said atmospheric pressure ion source is an ESI ion source.

15. An atmospheric pressure ionization mass spectrometer system according to claim 1, wherein said atmospheric pressure ion source is an APCI ion source.

* * * * *